United States Patent [19]

Kim

[11] Patent Number: 4,558,609

[45] Date of Patent: Dec. 17, 1985

[54] JOYSTICK CONTROLLER WITH INTERCHANGEABLE HANDLES

[75] Inventor: Syng N. Kim, Hoffman Estates, Ill.

[73] Assignee: Wico Corporation, Niles, Ill.

[21] Appl. No.: 456,261

[22] Filed: Jan. 6, 1983

[51] Int. Cl.[4] ..... G05G 9/00

[52] U.S. Cl. ..... 74/471 XY; 74/523; 74/551.9

[58] Field of Search ..... 74/471 XY, 523, 538, 74/551.9; 200/6 A; 403/298, 359; 16/114 R

[56] References Cited

U.S. PATENT DOCUMENTS

| | | | |
|---|---|---|---|
| 2,272,897 | 2/1942 | Riesing | 74/523 |
| 2,841,659 | 7/1958 | Eitel | 200/6 A X |
| 3,056,867 | 10/1962 | Eitel | 74/471 XY X |
| 3,298,245 | 1/1967 | Cross | 74/538 X |
| 3,314,716 | 4/1967 | Sommerer | 74/538 X |
| 4,138,905 | 2/1979 | Konishi | 74/538 X |
| 4,382,166 | 5/1983 | Kim | 200/18 X |

FOREIGN PATENT DOCUMENTS

| | | | |
|---|---|---|---|
| 125829 | 11/1947 | Australia | 200/6 A |
| 73780 | 2/1952 | Denmark | 74/551.9 |
| 1163428 | 2/1964 | Fed. Rep. of Germany | 200/6 A |
| 556110 | 7/1923 | France | 74/551.9 |
| 753372 | 10/1933 | France | 74/471 XY |
| 47031 | 3/1962 | Poland | 200/6 A |
| 1580005 | 11/1980 | United Kingdom | 74/538 |

*Primary Examiner*—William F. Pate, III
*Assistant Examiner*—Joseph M. Rolnicki
*Attorney, Agent, or Firm*—Emrich & Dithmar

[57] ABSTRACT

A handle assembly for a joystick controller includes a tiltably mounted, elongated, hollow, tubular shaft having an elongated rod extending coaxially therethrough. A helical compression spring is seated in a recess at one end of the shaft and coaxially encircles the rod for engagement with an enlarged-diameter button thereon, resiliently to urge the rod to a normal rest position projecting a predetermined distance from the adjacent end of the shaft. Several different-shaped handle members are interchangeably mounted on the shaft, each handle member having a cylindrical bore therethrough for receiving the shaft and frictionally engageable with a knurled portion on the outer surface of the shaft. The bore has a reduced diameter portion at one end thereof to limit the depth of insertion of the shaft.

8 Claims, 6 Drawing Figures

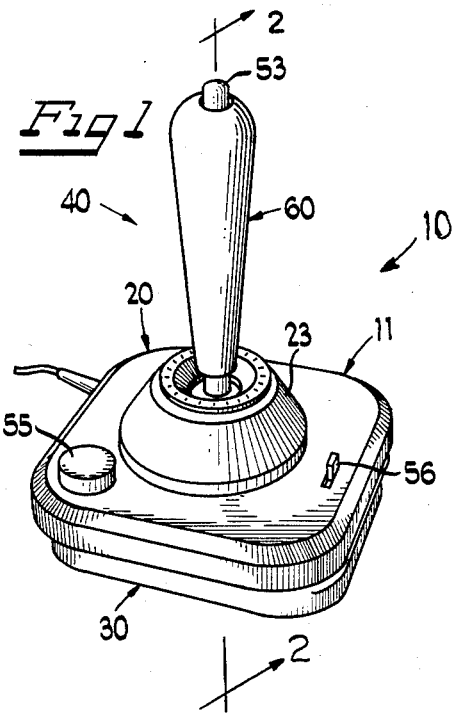
Fig 1
2
53
40
60
10
20
23
11
55
56
30
2
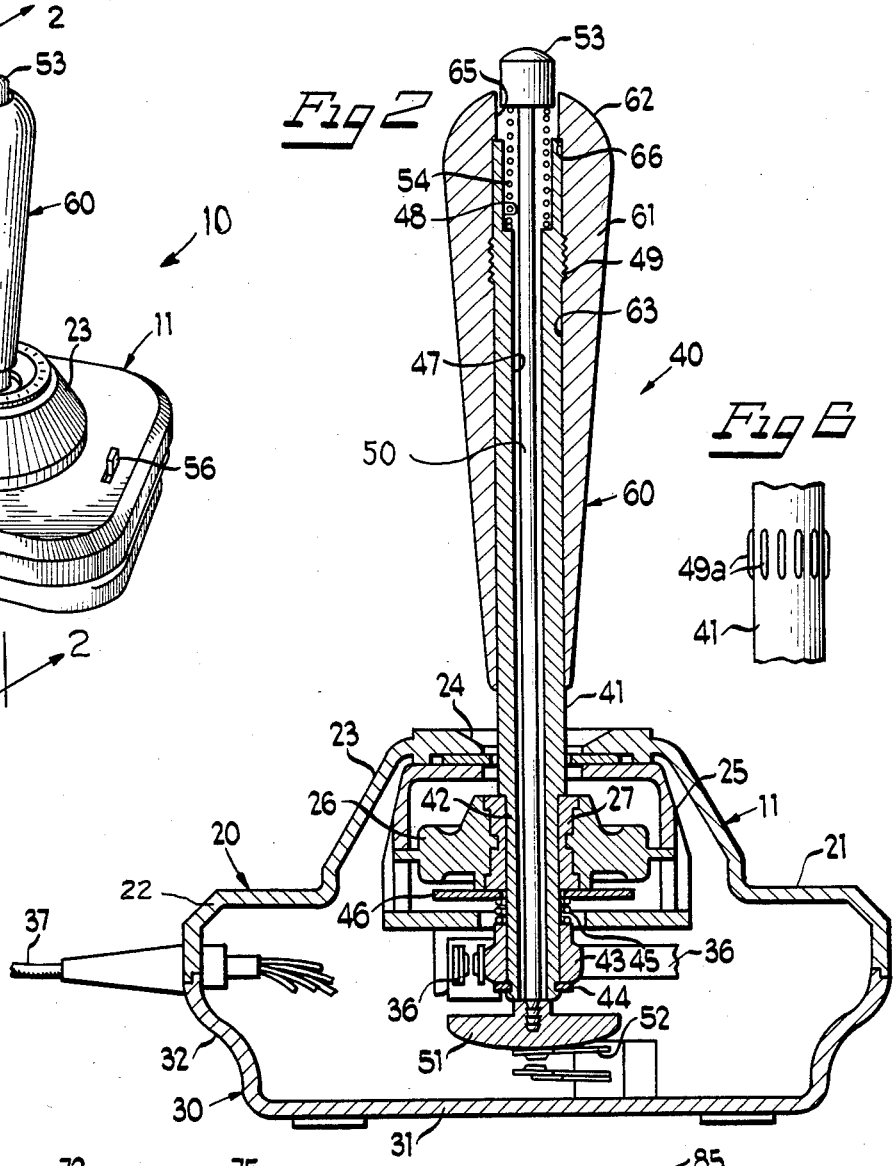
Fig 2
53
65
62
66
54
48
61
49
63
47
40
50
60
24
41
23
25
26
42
27
11
20
21
22
46
37
43
45
36
36
44
52
51
32
30
31
Fig 6
49a
41
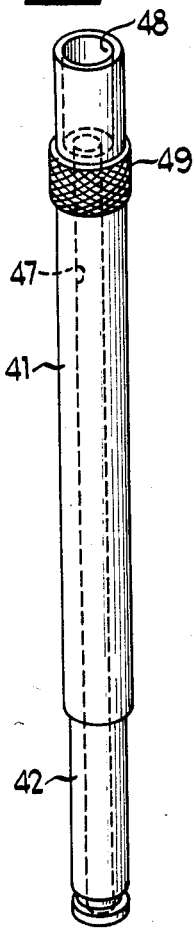
Fig 3
48
49
47
41
42
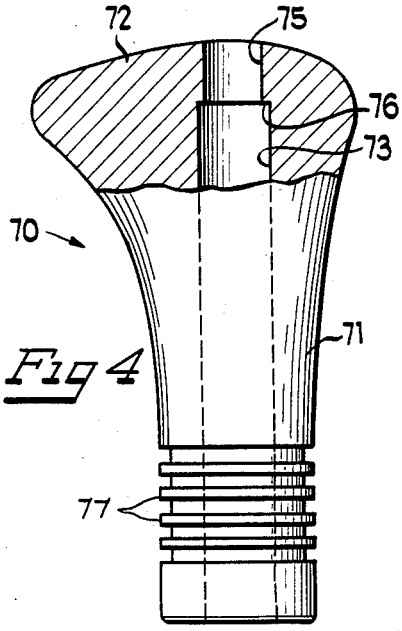
72
75
76
73
70
71
Fig 4
77
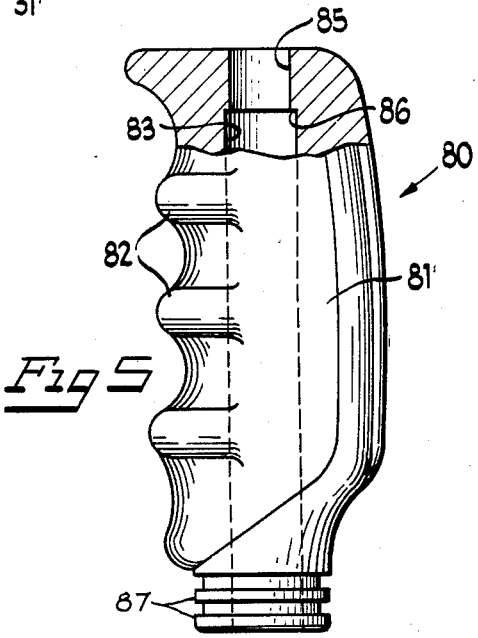
85
86
83
80
82
81
Fig 5
87

JOYSTICK CONTROLLER WITH INTERCHANGEABLE HANDLES

BACKGROUND OF THE INVENTION

The present invention relates to a joystick controller of the type which may be used for controlling the operation of certain electronic games and the like. For example, the joystick controller may be used to control the movement of a "blip" on the cathode-ray tube screen of a video game. Such joystick controllers are disclosed, for example, in my copending application Ser. No. 327,261, filed Dec. 3, 1981 and entitled "Joystick Controller with Built-in Fire Button", now U.S. Pat. No. 4,382,166 and in my copending application Ser. No. 423,812, filed Sept. 27, 1982 and entitled "Joystick Controller with Dual Firing Controls", now abandoned.

Prior joystick controllers are provided with a handle assembly which is tiltably mounted in a housing and projects therefrom for manual operation by a user. The handle assembly typically includes a handle member fixedly secured to a tiltably mounted shaft. The handle member may have any desired shape or configuration, depending upon the particular application in which the joystick controller is to be used. Since the handle member is fixedly secured to the shaft, a different handle shape requires the use of a different joystick controller, although the two joystick controllers may be identical with the exception of the handle member.

Furthermore, certain prior joystick controllers include handle-mounted fire buttons which are resiliently urged to a normal projecting position by a spring seated in the handle member. Thus, any change of the handle member would require disassembly of this push button mechanism.

SUMMARY OF THE INVENTION

It is a general object of the present invention to provide an improved joystick controller which avoids the disadvantages of prior controllers while affording additional structural and operating advantages.

An important object of this invention is the provision of a joystick controller having a handle member which can readily be removed.

In connection with the foregoing object, it is another object of this invention to provide a joystick controller of the type which includes a handle-mounted fire button, wherein the handle member can be readily removed without affecting the fire button mechanism.

Still another object of this invention is the provision of an improved joystick controller which has interchangeable handle members.

These and other objects of the invention are attained by providing a joystick controller including a housing and an elongated shaft tiltably carried by the housing, the improvement comprising: mounting means on the shaft, and handle means having a generally cylindrical inner surface telescopically receiving one end of the shaft thereinto, the inner surface being dimensioned for engagement with the mounting means to hold the handle means and the shaft together in an assembled condition while accommodating separation of the handle means from the shaft.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

FIG. 1 is a perspective view of a joystick controller constructed in accordance with and embodying the features of a first embodiment of the present invention, with a first of several interchangeable handle members thereon;

FIG. 2 is an enlarged view in vertical section taken along the line 2—2 of FIG. 1;

FIG. 3 is an enlarged, fragmentary, side elevational view of a portion of the handle shaft of the joystick controller of FIG. 2;

FIG. 4 is an enlarged, fragmentary, side elevational view of another of the interchangeable handle members of the present invention and with a portion of the handle member broken away;

FIG. 5 is a view, like FIG. 4 of another of the interchangeable handle members of the present invention; and FIG. 6 is a fragmentary elevational view illustrating another form of knurling on the handle assembly shaft.

DESCRIPTION OF THE PREFERRED EMBODIMENTS

Referring to FIGS. 1 through 3 and 6 of the drawings, there is illustrated a joystick controller, generally designated by the numeral 10, constructed in accordance with and embodying the features of the present invention. The joystick controller 10 has a two-part housing, generally designated by the numeral 11, which includes a cover or top 20 and a bottom 30, which cooperate to form a substantially closed housing. Tiltably mounted in the housing 11 is a handle assembly 40 which includes a handle member 60. With the exception of the handle assembly 40, the joystick controller 10 is substantially identical to that disclosed in my aforementioned copending application Ser. No. 423,812, the disclosure of which is incorporated herein by reference. Accordingly, only so much of the remainder of the joystick controller 10 will be disclosed herein as is necessary for an understanding of the present invention.

The cover 20 has a generally rectangular top wall 21 provided around the peripheral edges thereof with a continuous depending skirt or side wall 22. Integral with the top wall 21 centrally thereof and projecting upwardly therefrom is a generally frustoconical turret 23 having a circular aperture 24 in the upper end thereof. Mounted within the turret 23 is a handle support assembly 25, in which is mounted a flexible diaphragm 26. The diaphragm 26 has a central aperture therethrough in which is disposed a bushing 27. The bottom 30 of the housing 11 includes a generally rectangular bottom wall 31 integral at the perimeter thereof with a continuous upstanding skirt or side wall 32. The edges of the skirts 22 and 32 of the cover 20 and bottom 30, are flanged for mating engagement with each other for cooperation to form a closed housing. A plurality of leaf switches 36 (two shown) are disposed within the housing 11 beneath the handle support assembly 25. The edge of the cover skirt 22 is provided with a notch (not shown) for accommodating a cable 37.

Mounted on the cover 20 is the handle assembly 40, which includes an elongated, cylindrical, tubular shaft 41 which extends through the aperture 24 and has a reduced diameter inner end 42 extending through the bushing 27 coaxially therewith and secured thereto. The reduced diameter end 42 of the tubular shaft 41 extends beneath the handle support assembly 25 and has disposed in surrounding relationship therewith a cylindrical actuator 43, held in place as by an E-ring 44. Disposed in surrounding relationship with the tubular shaft 41 above the actuator 43 and bearing thereagainst is a helical compression spring 45, the upper end of which bears against a washer 46 which surrounds the tubular shaft 41 and bears against the other side of the flexible diaphragm 26, resiliently to urge the handle assembly 40 axially inwardly of the cover 20. The actuator 43 is disposed for engagement with the spring contacts of the leaf switches 36 in a well known manner. The tubular shaft 41 has an axial bore 47 therethrough having an enlarged-diameter upper end portion 48 defining a cylindrical recess. Formed on the outer surface of the tubular shaft 41 and extending circumferentially therearound a predetermined distance from the upper end thereof is a knurled mounting portion 49, which may be a crisscross knurling as illustrated in FIG. 3. FIG. 6 illustrates a straight knurling 49*a*, comprising a plurality of axially extending ribs equiangularly spaced apart, which is preferably disposed lower on the tubular shaft 41. Such straight knurling could also be substituted for the knurling 49.

Extending axially through the bore 47 is an elongated rod 50. The inner end of the rod 50 projects beyond the inner end of the tubular shaft 41 and is fixedly secured to a circular actuator 51. The actuator 51 is disposed for engagement with the spring contacts of a leaf switch 52. The rod 50 is provided at the other end thereof with an enlarged diameter push button 53. Disposed in surrounding relationship with the rod 50 and seated in the enlarged-diameter upper end portion 48 of the bore 47 is a helical compression spring 54 which bears against the push button 53 and resiliently urges the rod 50 axially upwardly to a normal rest position, illustrated in FIG. 2, wherein the push button 53 is disposed a predetermined distance above the upper end of the tubular shaft 41. The joystick controller 10 also includes a push button 55 (see FIG. 1) projecting upwardly through a complementary opening in the cover 20 for actuating an auxiliary switch (not shown), and a selector switch 56 for selectively connecting in circuit either the leaf switch 52 or the auxiliary switch. The mounting of the several switches and the interconnection thereof is described in greater detail in the aforementioned copending application Ser. No. 423,812.

The handle assembly 40 includes a handle member, generally designated by the numeral 60, comprising an elongated frustoconical body 61 having a part-spherical top 62 and provided with an elongated cylindrical bore 63 extending axially therethrough, the bore 63 having an inner diameter very slightly greater than the outer diameter of the tubular shaft 41. The bore 63 has a reduced diameter upper end portion 65 which defines an annular shoulder 66.

It is a significant aspect of the present invention that the handle member 60 is dimensioned to be frictionally fitted telescopically over the upper end of the tubular shaft 41, the knurled mounting portion 49 on the tubular shaft 41 frictionally engaging the wall of the bore 63 so as firmly to hold the handle member 60 in place on the tubular shaft 41, while accommodating ready removal of the handle member 60 from the tubular shaft 41. The reduced diameter upper end portion 65 of the bore 63 has an inner diameter less than the outer diameter of the tubular shaft 41, so that the shoulder 66 serves as a stop engageable with the upper end of the tubular shaft 41 to limit the depth of insertion thereof into the handle member bore 63 at an assembled position. The push button 53 on the rod 50 has an outer diameter slightly less than the inner diameter of the reduced diameter upper end portion 65 of the bore 63 so as to be freely accommodated therein. In use, when the handle member 60 has been mounted in its assembled position on the tubular shaft 41, the push button 53 projects a predetermined distance upwardly above the top 62 of the handle member 60 for access by a user. In the embodiment of FIG. 6, the knurling 49*a* will engage the lower end of the handle member 60 in its assembled position.

Since the diameter of the push button 53 is less than that of the tubular shaft 41, it will be appreciated that the handle member 60 can be pushed onto and pulled off of the tubular shaft 41 without disturbing the position of the rod 50 and the push button 53. Accordingly, the handle member 60 may be readily interchangeable with other shapes of handle members. Referring to FIGS. 4 and 5 of the drawings, two alternative handle configurations are illustrated.

In FIG. 4 there is shown a handle member 70 which has an elongated body 71 provided with an enlarged, generally anvil-shaped top 72. The body 71 has a cylindrical bore 73 extending axially therethrough from the top to the bottom thereof and having a reduced diameter upper end portion 75 which defines an annular shoulder 76. External circumferential ribbing 77 may be provided around the lower end of the body 71 for decorative purposes. Thus, it can be seen that the handle member 70 differs from the handle member 60 only in external shape, its mounting on and demounting from the tubular shaft 41 being exactly the same as was described above with respect to the handle member 60.

Similarly, there is illustrated in FIG. 5 a handle member 80 which includes an elongated body 81 provided with finger grip indentations 82 along one side thereof. A cylindrical bore 83 extends axially through the body 81 from the top to the bottom thereof and is provided at the upper end thereof with a reduced diameter end portion 85 defining an annular shoulder 86. Decorative ribbing 87 may be provided around the lower end of the handle member 80. The mounting and demounting of the handle member 80 is exactly the same as was described above with respect to the handle member 60.

From the foregoing, it can be seen that there has been provided an improved joystick controller with a handle assembly having interchangeable handle members which can be mounted and removed without disturbing the position of a fire button carried by the handle assembly. It will be appreciated that other shapes of handle member could be provided which are interchangeable with the handle members 60, 70 and 80.

I claim:

1. In a joystick controller including a housing, an elongated hollow tubular shaft tiltably carried by the housing and having an outer surface and an elongated rod disposed in the shaft coaxially therewith and spaced radially therefrom and projecting therefrom for reciprocating movement with respect thereto, the improvement comprising: handle mounting means on the shaft, and removable handle means having a top end and having a bore therethrough defining a cylindrical inner surface telescopically received over one end of the shaft, said inner surface being dimensioned for frictional engagement with said handle mounting means to hold said handle means in an assembled condition on the shaft while accommodating movement of said handle means to and from the assembled condition thereof without affecting the rod, the shaft having an enlarged-inner-diameter counterbore at said one end thereof, and a helical compression spring disposed in said counterbore and engageable with the rod for resiliently urging the rod to a normal rest position projecting a predetermined distance from said one end of said shaft.

2. The joystick controller of claim 1, wherein said knurled portion extends circumferentially around the shaft and has an axial extent which is a relatively small fraction of the length of the shaft.

3. The joystick controller of claim 1, wherein said mounting means comprises a knurled portion on the outer surface of the shaft.

4. The joystick controller of claim 1, wherein the rod has an enlarged-diameter button at one end thereof having a maximum outer diameter, said shaft having an outer diameter greater than the maximum outer diameter of said button or said bias means.

5. The joystick controller of claim 1, wherein the rod projects a predetermined distance beyond the top end of said handle means in the assembled condition thereof.

6. The joystick controller of claim 5, and further including stop means on said handle means engageable with the shaft for limiting insertion thereof in said bore.

7. The joystick controller of claim 6, wherein said stop means comprises a reduced-diameter portion of said inner surface at one end of said handle means.

8. The joystick controller of claim 1, and further including a plurality of said handle means having different external shapes, said handle means being interchangeably mountable on the shaft in said assembled condition.

* * * * *

UNITED STATES PATENT AND TRADEMARK OFFICE

CERTIFICATE OF CORRECTION

PATENT NO. : 4,558,609

DATED : Dec. 17, 1985

INVENTOR(S) : Syng N. Kim

It is certified that error appears in the above-identified patent and that said Letters Patent is hereby corrected as shown below:

Column 5, line 18, delete "knurled portion" and insert --mounting means comprises a knurled portion on the outer surface of the shaft which--.

Signed and Sealed this

*Twenty-fifth* Day of *March 1986*

[SEAL]

*Attest:*

DONALD J. QUIGG

*Attesting Officer*

*Commissioner of Patents and Trademarks*